US006632166B2

(12) United States Patent
Carr

(10) Patent No.: US 6,632,166 B2
(45) Date of Patent: Oct. 14, 2003

(54) CENTRIFUGE HAVING AXIALLY MOVABLE SCRAPING ASSEMBLY FOR AUTOMATIC REMOVAL OF SOLIDS

(76) Inventor: Robert B. Carr, 315 Mansfield St., Sharon, MA (US) 02067

( * ) Notice: Subject to any disclaimer, the term of this patent is extended or adjusted under 35 U.S.C. 154(b) by 0 days.

(21) Appl. No.: 09/896,551

(22) Filed: Jun. 29, 2001

(65) Prior Publication Data

US 2002/0016243 A1 Feb. 7, 2002

Related U.S. Application Data

(60) Provisional application No. 60/223,409, filed on Aug. 4, 2000.

(51) Int. Cl.[7] ..... B04B 11/08

(52) U.S. Cl. ..... 494/37; 494/50; 494/58; 494/59; 494/65; 210/376; 210/377

(58) Field of Search ..... 494/37, 50, 55, 494/58, 59, 65, 52, 84; 210/360.1, 372–377, 380.1

(56) References Cited

U.S. PATENT DOCUMENTS 1,117,195 A * 11/1914 Kopke
1,903,298 A * 4/1933 Roberts
1,909,188 A 5/1933 Roberts
2,360,455 A * 10/1944 Vilter
2,692,725 A * 10/1954 Hensgen
2,752,044 A * 6/1956 Olcott
2,894,634 A * 7/1959 Lepoutre
2,953,250 A * 9/1960 Jung et al.
3,279,612 A * 10/1966 O'Conor
3,279,613 A * 10/1966 Daubman, Jr. et al.
3,402,823 A * 9/1968 Gruner
3,403,848 A * 10/1968 Windsor et al.
3,474,905 A * 10/1969 Titus
3,589,596 A * 6/1971 O'Conor et al.
3,741,465 A * 6/1973 Lincoln
4,155,503 A 5/1979 Sears
4,416,655 A * 11/1983 Bennett
4,493,768 A 1/1985 Kubr et al.
4,493,769 A 1/1985 Paschedag et al.
4,522,620 A * 6/1985 Leister
4,692,247 A 9/1987 Orlans
5,250,180 A * 10/1993 Chang
5,328,441 A 7/1994 Carr ..... 494/58

(List continued on next page.)

FOREIGN PATENT DOCUMENTS

DE 3927707 * 3/1990

OTHER PUBLICATIONS

Carr Powerfuge Brochure, Carr Separations, Inc., undated, p. 1–4.

Alfa–Laval CHPX Centrifuge Brochure, Alfa Laval, Inc., undated, p. 1.

Shanghai Centrifuge Institute, SCI Tube Bowl Centrifuge, Shanghai, China, undated, p. 1–2.

*Primary Examiner*—Charles E. Cooley

(57) ABSTRACT

A centrifugal separator includes a rotatable separator bowl, a hollow shaft spindle in the bowl along the rotational axis of the bowl, and a variable-drive motor for selectively rotating the bowl at a high separating speed and at a lower scraping speed. A scraper and feed assembly including scraper blades is supported by the shaft spindle within the separator bowl. A feed liquid is supplied to the separator bowl via the scraper and feed assembly at substantially the interior surface of the separator bowl. The scraper assembly rotates with the bowl at the separating speed while centrate is drawn off. While the bowl is operated at the scraping speed, the scraper assembly is prevented from rotating with the bowl and is moved axially with respect to the bowl to scrape accumulated solids from the interior surface of the bowl. Loosened solids exit the centrifuge via a discharge port at the bottom of the bowl.

21 Claims, 6 Drawing Sheets

U.S. PATENT DOCUMENTS

| | | | | | |
|---|---|---|---|---|---|
| 5,356,367 | A | | 10/1994 | Carr | 494/58 |
| 5,425,698 | A | | 6/1995 | Carr | 494/46 |
| 5,454,777 | A | * | 10/1995 | Ziems et al. | |
| 5,460,717 | A | * | 10/1995 | Grimwood et al. | |
| 5,674,174 | A | | 10/1997 | Carr | 494/65 |
| 5,733,238 | A | | 3/1998 | Carr | 494/58 |
| 5,743,840 | A | * | 4/1998 | Carr | |
| 5,823,937 | A | * | 10/1998 | Carr | |
| 5,879,279 | A | * | 3/1999 | Berger et al. | |
| 6,126,587 | A | * | 10/2000 | Berger et al. | |
| 6,224,532 | B1 | * | 5/2001 | Beattey | |

* cited by examiner

CENTRIFUGE HAVING AXIALLY MOVABLE SCRAPING ASSEMBLY FOR AUTOMATIC REMOVAL OF SOLIDS

CROSS REFERENCE TO RELATED APPLICATIONS

This application claims priority under 35 U.S.C. §119(e) to provisional patent application Ser. No. 60/223,409 filed Aug. 4, 2000, the disclosure of which is hereby incorporated by reference.

STATEMENT REGARDING FEDERALLY SPONSORED RESEARCH OR DEVELOPMENT

N/A

BACKGROUND OF THE INVENTION

The present invention generally relates to centrifuges and in particular to a centrifuge enabling automatic discharge of solids from a separated centrate.

Many different types of centrifugal separators are known for separating heterogeneous mixtures according to "their specific gravities components". A heterogeneous mixture, which may also be referred to as feed material or liquid feed, is injected into a rotating bowl of the separator. The bowl rotates at high speeds and forces particles of the mixture to separate from the liquid centrate. As a result, a dense solids cake compresses tightly against the surface of the bowl and the liquid centrate forms radially inward from the solids cake.

The bowl may rotate at speeds sufficient to produce 20,000 g's so that the solids may be separated from the centrate. Typically, the liquid feed travels at a relatively slow speed before being introduced through feed holes to the rotating bowl where the liquid feed is instantaneously accelerated to the angular speed of the rotating bowl. However, introducing the liquid feed to the bowl at such high speeds creates shear forces that often destroy a large amount of the solid component of the liquid feed before separation.

While the solids accumulate along the wall of the bowl, the centrate is drained. Once it is determined that a desired amount of the solids has been accumulated, the separator is placed in a discharge mode. In one such discharge mode, a scraper blade extending the length of the rotating bowl is placed in a scraping position against the separator wall and the bowl is rotated at a low scraping speed. Then, the solids are scraped from the sides of the bowl and fall toward a solids collecting outlet. However, such scraping systems do not effectively remove wet or sticky solids which may have the consistency of peanut butter. In such instances, the sticky solids remain stuck on the separator wall and scraper blades or fall from the wall and then reattach to the blades before reaching the collecting outlet. As a result, the solids recovery yield is reduced and the remaining solids undesirably contaminate the separator.

BRIEF SUMMARY OF THE INVENTION

In accordance with the present invention, a centrifugal separator is provided which automatically discharges solids and maximizes the amount of solids recovery yield and the dryness of the separated solids with minimal user intervention. Full hermetic containment of the separation process is achieved by this centrifugal separator so that automatic "clean in place" (C.I.P.) and "sterilization in place" (S.I.P.) operations may be performed. Accordingly, the centrifugal separator of the present invention is able to perform a wide range of liquid/solid and liquid/liquid separations in biotechnology, pharmaceutical, chemical, food and beverage, and other industrial processes.

The centrifugal separator includes a rotatable separator bowl supported by a hollow shaft spindle. The shaft spindle also supports and positions a scraper and feed assembly for axially moving within the separator bowl. The scraper and feed assembly includes a plurality of scraper blades having a small surface area that extend to substantially the interior surface of the separator bowl. A feed liquid is supplied to the separator bowl by liquid feed passages which pass through the shaft spindle to the scraper and feed assembly so that the feed liquid exits proximate the ends of the scraper blades at substantially the interior surface of the separator bowl. This prevents the feed liquid from being instantaneously over-accelerated due to the angular velocity of the separator bowl. As a result, the feed liquid is subjected to shear forces that are greatly reduced and the feed liquid is less likely to be harmed as compared to the prior art.

The separator bowl is preferably a tubular bowl having a relatively small diameter and a long length. By the use of such tubular separator bowls, high speed operations of the centrifugal separator may be performed to generate separation forces as high as 30,000 g's at the interior surface of the separator bowl. This allows the feed liquid to be safely and effectively separated at lower stress levels within the separator bowl.

As a result of the high speed operation, the centrifugal separator is able to more effectively separate the solids from the residual liquid so that the dryness of the accumulated solids cake is increased. Even though the scraper blades have a relatively small surface area, the solids from the walls of the separator bowl may be more easily and effectively scraped. To scrape and discharge all of the accumulated solids, the scraper and feed assembly is slowly raised then lowered while the separator bowl is slowly rotated. By the combination of the accumulated solids being drier and the scraper blades having a small scraping surface area, the amount of the discharged solids is greatly increased. The centrifugal separator according to the present invention may thereby be operated aseptically and provide C.I.P. or S.I.P. operations.

BRIEF DESCRIPTION OF THE SEVERAL VIEWS OF THE DRAWING

The invention will be more fully understood by reference to the following detailed description of the invention in conjunction with the drawings, of which.

DETAILED DESCRIPTION OF THE INVENTION

Figure 1:
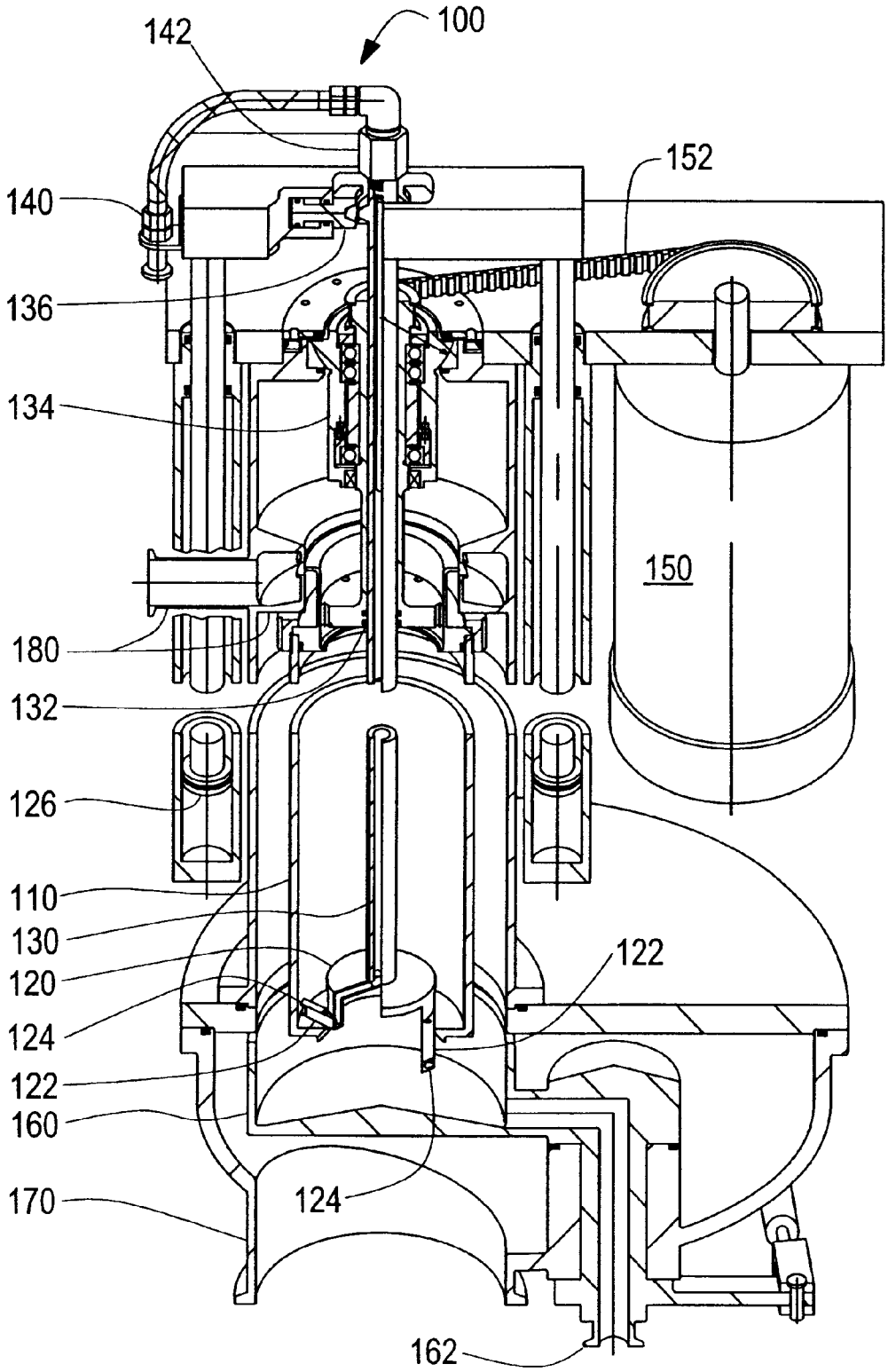
FIG. 1 illustrates a centrifugal separator according to an embodiment of the present invention.

A centrifugal separator 100 according to one embodiment of the present invention is illustrated in FIG. 1. The centrifugal separator 100 includes a cylindrical separator bowl 110, preferably a conventional tubular type bowl having a relatively small diameter D and a long length L such that the ratio of L/D is approximately 5/1. For example, a separator bowl 110 having a bowl diameter up to 500 mm and a flow capacity up to 100 l/min. may be used so that sufficient rotational speeds may be achieved at the interior surface of the separator bowl 110 to generate separation forces from 20,000 g's to 30,000 g's. Tubular type bowls provide cost and performance advantages over other known cylindrical bowls, such as "basket" type centrifuge bowls, for similar pool areas and gravitational forces. For instance, because the radius of the tubular bowls are much smaller, lower peripheral velocity results which reduces windage, friction and heat generation. Also, the longer length of the tubular bowl provides better liquid stability because axial liquid waves are damped out.

A scraper and feed assembly 120 is operatively connected to a hollow scraper shaft spindle 130 within the separator bowl 110. The scraper shaft spindle 130 extends out from the separator bowl 110 to a feed pipe 140. A scraper shaft seal 132 is positioned where the scraper shaft 130 extends from the separator bowl 110 to prevent liquids and solids from escaping the separator bowl 110. A rotary union 142 connects the feed pipe 140 to the scraper shaft spindle 130 so that the liquid feed may be injected into the separator bowl 110.

A variable speed drive motor 150 is connected to a main bearing assembly 134 of the scraper shaft spindle 130 by a drive belt 152. The drive motor 150 is controllably operated in conjunction with a scraper shaft clutch 136 to rotate the separator bowl 110 at the desired speeds for separating the liquid feed. A scraper actuator piston 126 is also operatively connected to the scraper shaft spindle 130 in combination with the scraper shaft clutch 136 for raising and lowering the scraper and feed assembly 120 within the separator bowl 110. In a discharge mode, the scraper shaft clutch 136 is engaged for holding the scraper shaft spindle 130 stationary and slowly rotating the separator bowl 110 at a low scraping speed so that scraper blades maintain contact and scrape solids from the walls of the separator bowl 110. In other operating modes, the scraper shaft clutch 136 is disengaged so that the scraper and feed assembly 120 rotates at the same speed and in the same direction as the separator bowl 110 (i.e., the scraper and feed assembly 120 is stationary relative to the separator bowl 110).

Figure 2:
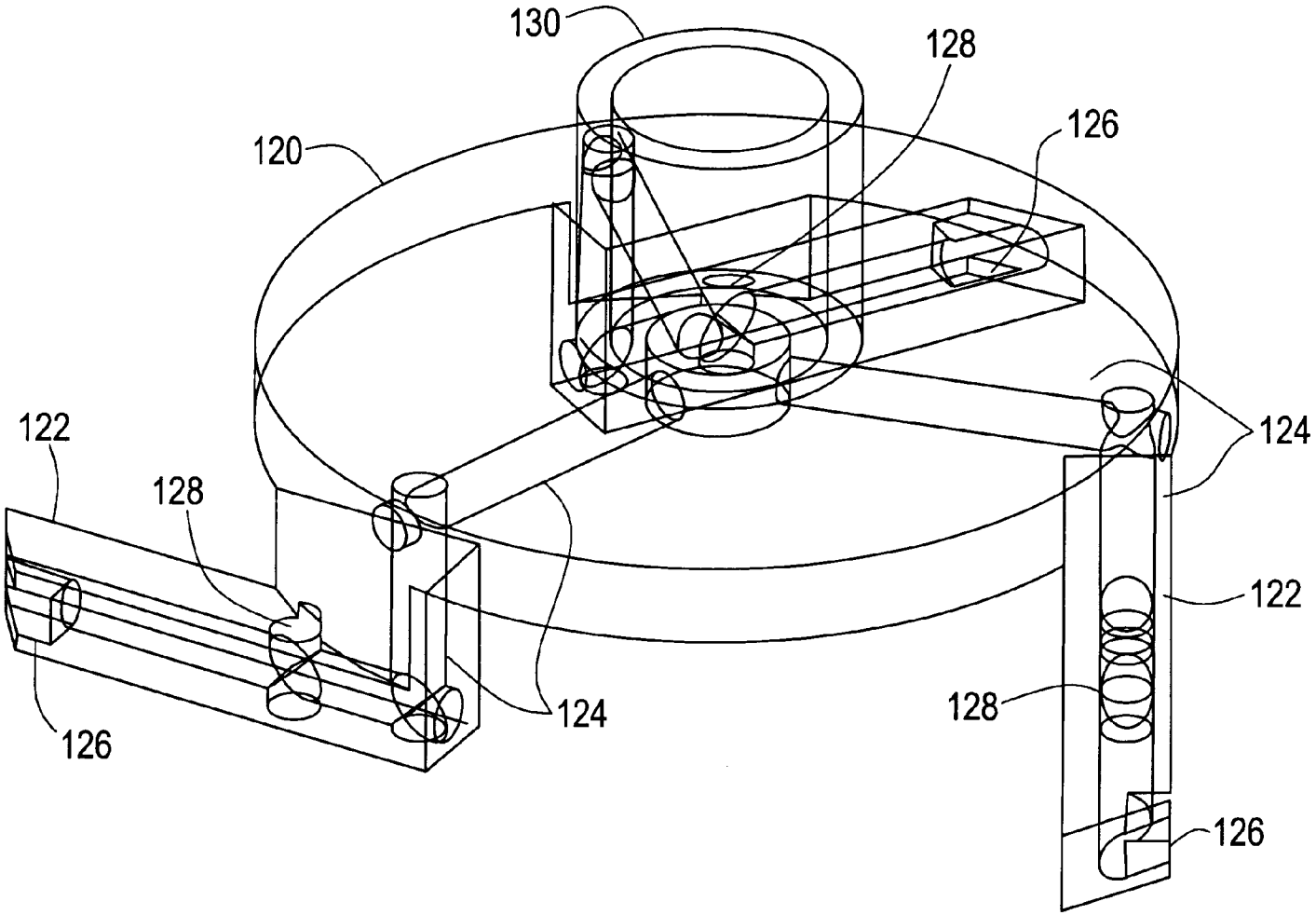
FIG. 2 is a transparent view of a scraper and feed assembly according to an embodiment of the present invention.

A more detailed view of the scraper and feed assembly 120 is shown in FIG. 2. FIG. 2 illustrates three axial scraper blades 122 attached to the scraper and feed assembly 120. It should be appreciated that the scraper and feed assembly 120 may be designed with a varying number of scraper blades 122 depending on the surface area of the separator bowl 110 that is desired to be scraped while maintaining a stable and high speed rotation.

The scraper and feed assembly 120 includes liquid feed passages 124 that channel the feed liquid from the scraper shaft spindle 130 and through the scraper and feed assembly 120 to first and second outer feed holes 126 and 128 on the scraper blades 122 so that the liquid feed is ejected at the surface of the separator bowl 110. The coriolis force due to the rotation of the scraper and feed assembly 120 causes the feed liquid to accelerate towards the first outer feed hole 126 at the surface of the separator bowl 110. If the feed liquid is prevented from exiting at the first outer feed hole 126 due to an accumulation of solids or other means, the liquid may exit at the second outer feed hole 128 with substantial acceleration towards the surface of the separator bowl 110. By ejecting the feed liquid away from the scraper and feed assembly 120 and towards the surface of the separator bowl 110, the liquid is more gradually accelerated and is prevented from being instantaneously accelerated due to the angular velocity at which the bowl is rotating. Thereby, the shear forces to which the feed liquid are subjected are greatly reduced so that the feed liquid is less likely to be damaged.

It is to be noted that in the illustrated embodiment of FIG. 2, drill holes formed on the surface of the scraper and feed assembly 120 during the creation of the feed passages 124 are subsequently filled. Other fabrication techniques may obviate the need for drilling and filling these surface holes.

Figure 3:
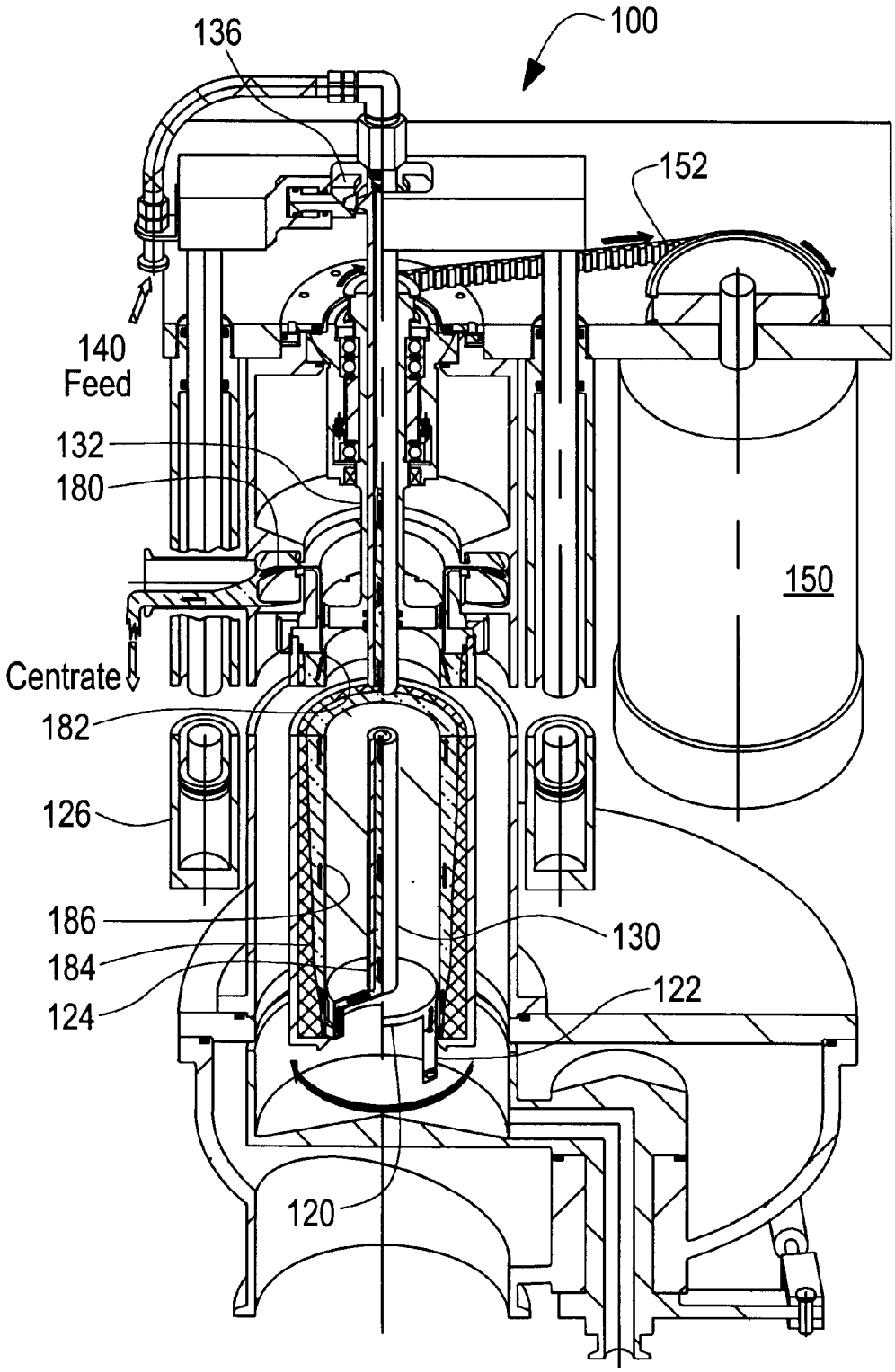
FIG. 3 illustrates the operation of a centrifugal separator in a feed mode according to an embodiment of the present invention.

In accordance with the operation of the centrifugal separator 100, a feed mode for the liquid feed will be described with reference to FIG. 3. In the feed mode, the feed liquid is introduced through the feed pipe 140. The scraper clutch 136 is disengaged so that the scraper shaft spindle 130 is free to rotate with the separator bowl 110. The feed liquid flows from the feed pipe 140 through the scraper shaft seal 132 to the scraper shaft spindle 130 in the direction shown by the arrows. The feed liquid continues through the feed passages 124 of the scraper and feed assembly 120 and enters the separator bowl 110 at its outer surface. Due to the centrifugal force, the liquid flows up the pool surface of the separator bowl 110. Any overflow feed liquid decants over a weir 182 as clarified liquid (centrate) at the top of the separator bowl 110 and then flows into a centrate case 180. As the liquid flows through the separator bowl 110, it is clarified of entrained solid particles by the high centrifugal force acting upon the liquid. The solids are forced to settle on the inside wall of the separator bowl 110 and collect as a compressed solids cake as a result of the centrifugal force.

Because the scraper clutch 136 is not engaged, the separator bowl 110 and the scraper and feed assembly 120 rotate together in the same direction at a high speed, for example in a clockwise direction as indicated by the arrow. Accordingly, the liquid feed passing through the scraper shaft 130 is gradually accelerated through the feed passages 124 to the angular velocity of the scraper and feed assembly 120. As the separator bowl 110 rotates, solids 184 collect along the surface of the separator bowl 110 and a rotating liquid pool 186 forms inward from the solids 184.

Figure 4:
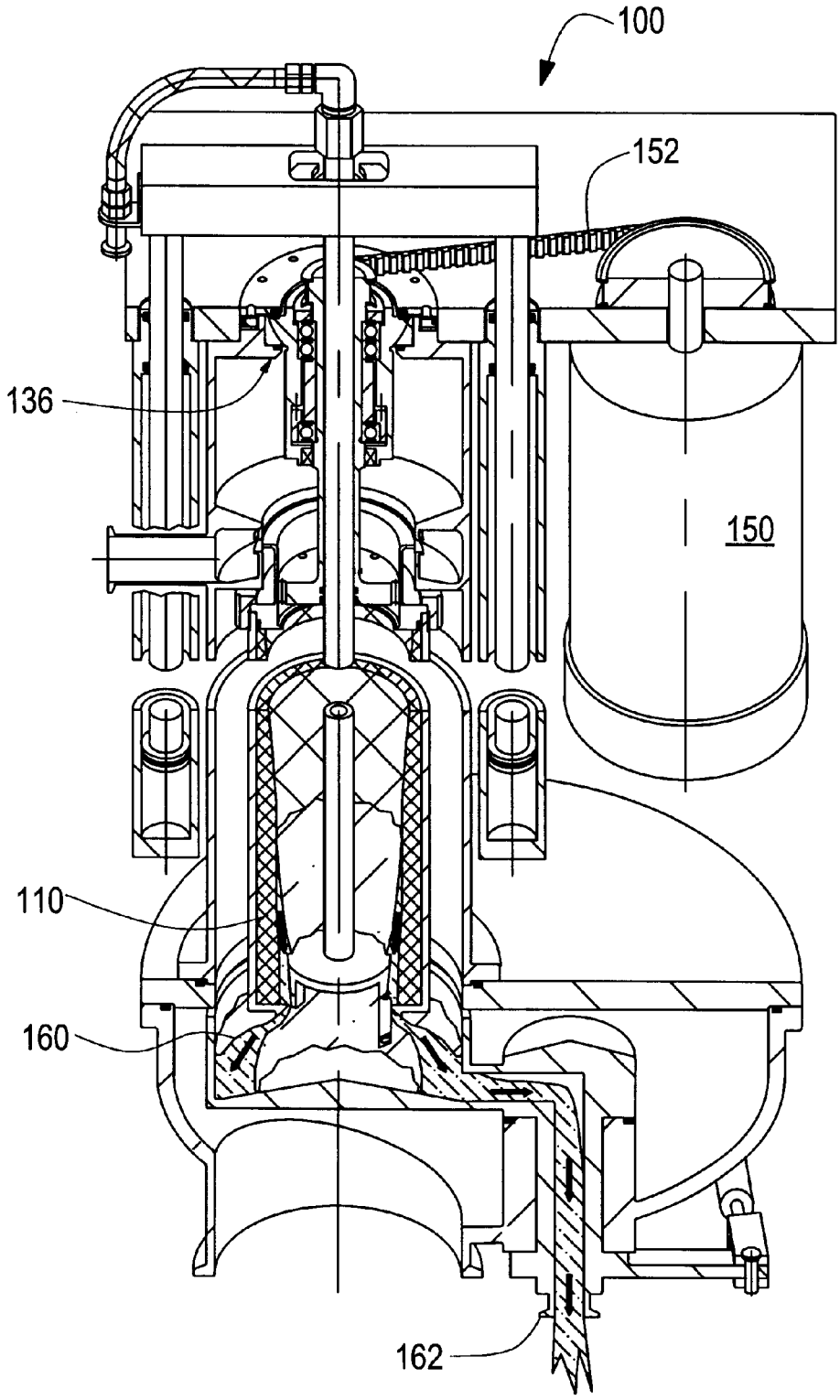
FIG. 4 illustrates the operation of a centrifugal separator in a drain mode according to an embodiment of the present invention.

Next, the centrifugal separator 100 is placed in a bowl drain mode as shown in FIG. 4 when the separator bowl 110 has been determined to be sufficiently full of solids, usually by the turbidity of the centrate. The liquid feed is shut off and then the bowl driver electronically brakes the separator bowl 110 to a full stop. The residual liquid in the separator bowl 110 drains into a residual liquid cup 160 while the solids remain on the surface of the separator bowl 110. The residual liquid cup 160 is preferably provided with a shaped bottom surface for channeling the residual liquid to a residual liquid discharge port 162 located at the bottom of the residual liquid cup 160 for transport of the residual liquid back to liquid feed storage (not shown). The bowl drain mode may also include a step of rotating the separator bowl 110 briefly at a high speed to further drain liquid from the accumulated solids. After this optional spinning step, the solids become drier which improves the efficiency of the subsequent scraping steps.

Figure 5:
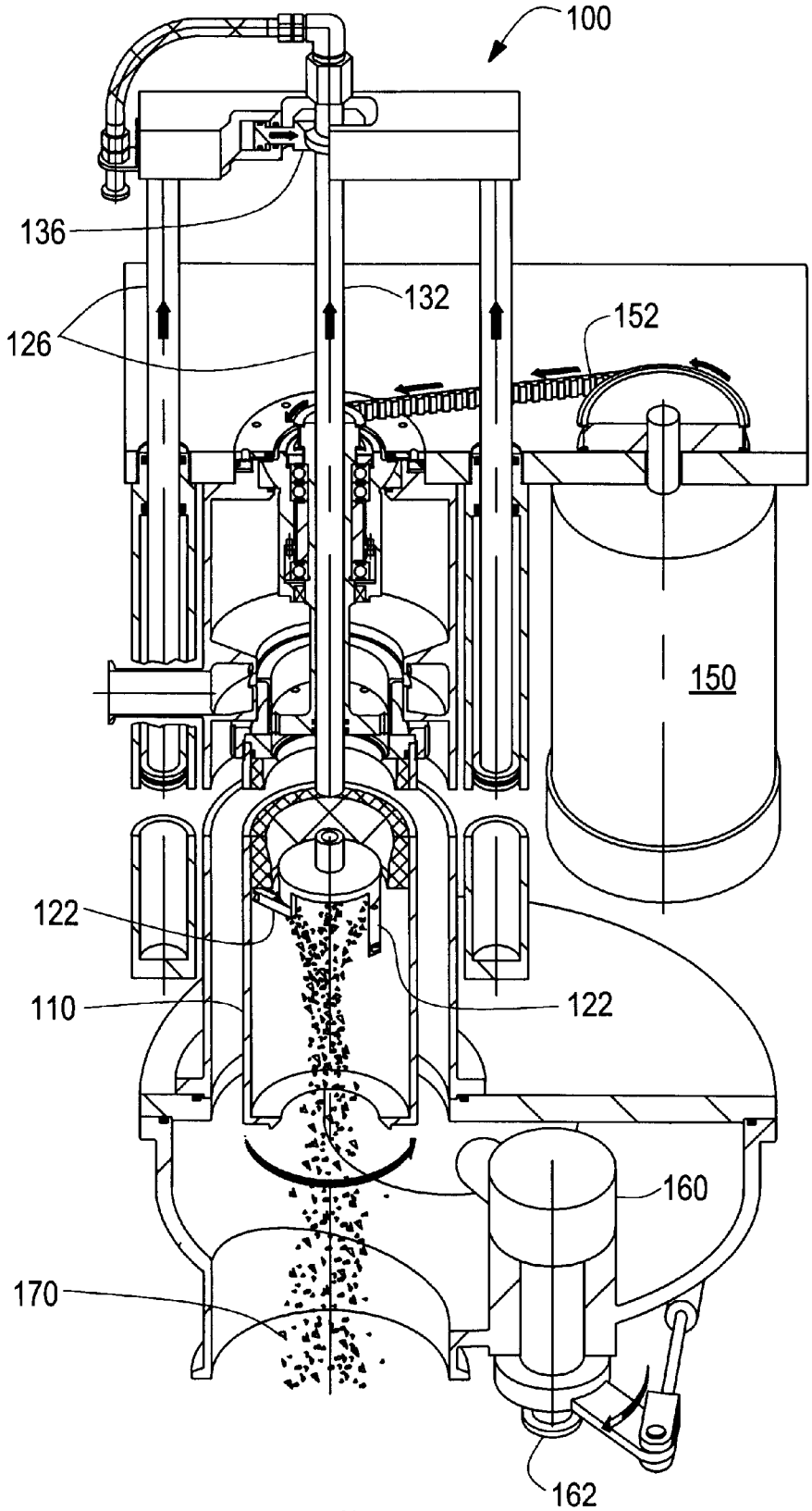
FIG. 5 illustrates the operation of a centrifugal separator in a scrape mode according to an embodiment of the present invention.

When the separator bowl 110 has been completely drained of residual liquid, the centrifugal separator 100 as shown in FIG. 5 enters a scrape mode. The residual liquid cup 160 swings away from the bottom of the separator bowl 110 so that a solids discharge port 170 is positioned beneath the bowl 110 to collect falling solids without mixing with the residual liquid.

With reference again to FIG. 1, it will be appreciated that the width of each scraper blade 122, measured in a direction parallel to the axis of symmetry of the separator bowl 110, is substantially less than the overall length of the separator bowl 110 itself.

The scraper shaft 130 is engaged by the scraper clutch 136 to prevent the scraper shaft 130 from rotating. The separator bowl 110 rotates slowly in an opposite direction from the feed mode (in a counter clockwise direction as shown by the arrow in FIG. 5). Then, the scraper actuator 126 slowly draws up the scraper shaft 130 and the scraper and feed assembly 120 up towards the top of the separator bowl 110 as indicated by the arrows. The solids cake is scraped from the walls of the separator bowl 110 and towards the center of the separator bowl 110 so that the scraped solids are free to fall out of the discharge port 170 and into a receiving container (not shown). After the scraper and feed assembly 120 reaches the reversing point near the top of the separator bowl 110, the scraper actuator 126 reverses in direction so that the scraper shaft 130 and the scraper and feed assembly 120 descend toward the bottom of the separator bowl 110. The scraping process continues until the stopping point near the bottom of the separator bowl 110 is reached. It is appreciated that the solids scraping from the separator bowl 110 can be performed in either direction (both counter clockwise and clockwise).

Figure 6B:
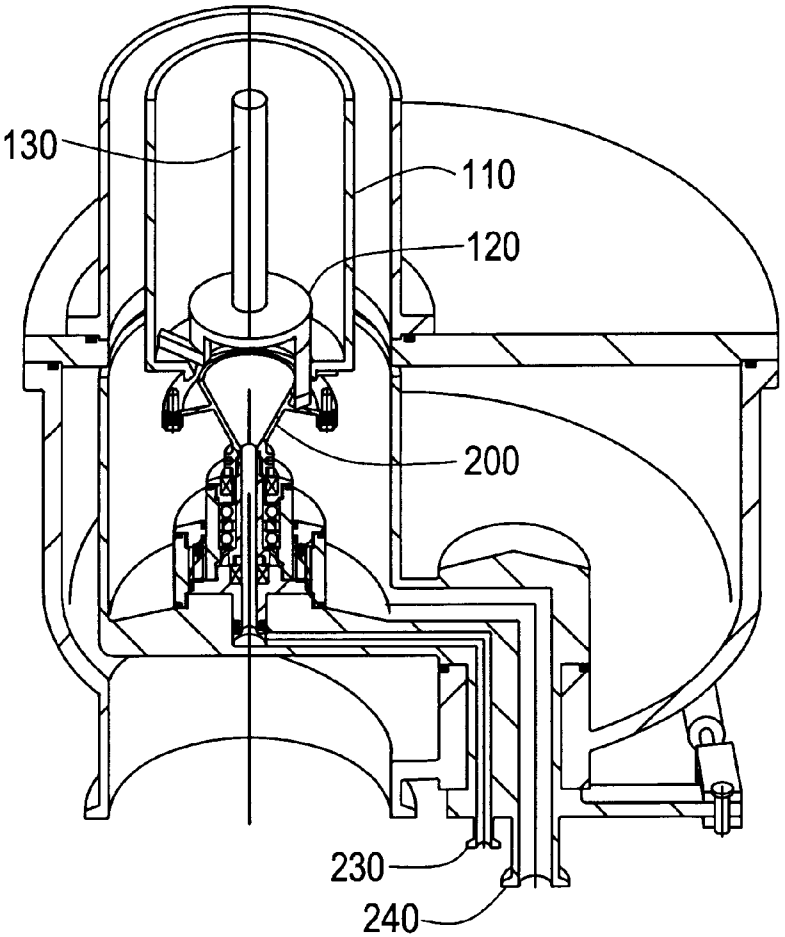
FIGS. 6A and 6B illustrate a centrifugal separator utilizing a feed cone in another embodiment of the present invention.
Figure 6A:
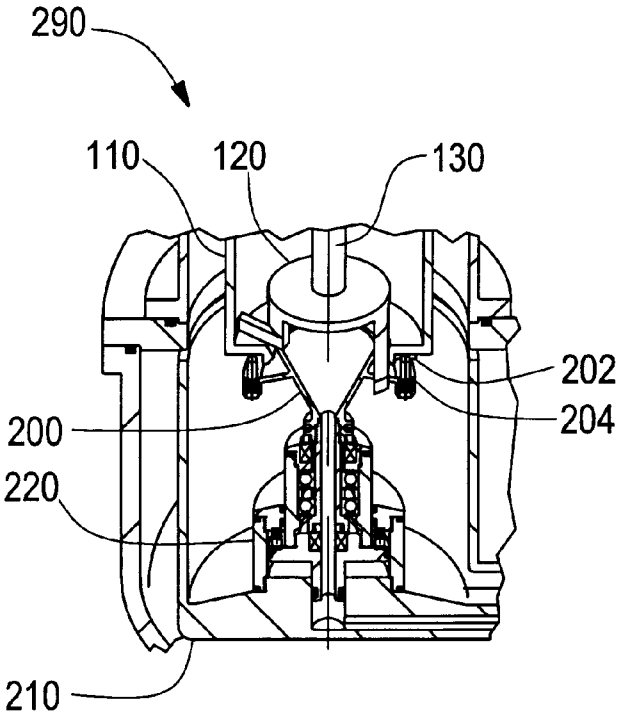

In another embodiment of the invention, a centrifugal separator 200 having an alternative liquid feed path is shown in FIGS. 6A and 6B. A feed cone 200 positioned at the bottom of the separator bowl 110 is used to feed liquid up into the separator bowl 110. The feed cone 200 is caused to rotate by plastic pins 204 on the feed cone 200 and metal vanes 202 on the separator bowl 110. This method of rotating the feed cone 200 with the separator bowl 110 allows the separator bowl 110 to go through mild oscillations; the separator bowl 110 maintains its center of rotation while being filled with liquid and is not restricted by the feed cone 200. The feed liquid is injected through a feed port 230 when the feed cone 200 is positioned in an upper connect position to the separator bowl 110 for a feed mode. A positioning mechanism 220, including bearings, shaft seals, and an actuator piston, is used to raise and lower the feed cone 200 between the feed mode as illustrated in FIG. 6A and a liquid drain mode as illustrated in FIG. 6B. In the drain mode the feed cone 200 is lowered by the positioning mechanism so that residual liquid may drain down from the separator bowl 110 through a residual liquid port 240. Subsequently, the feed cone 200 is pivoted from beneath the separator bowl 110 to enable scraped solids to fall into the solids discharge port 170.

The liquid feed apparatus of FIGS. 1–5 or of FIGS. 6A and 6B can also be used for the purpose of cleaning the centrifuge and associated elements through the introduction of appropriate liquid cleaning agents in the liquid feed path.

In a preferred embodiment, all of the separating, draining and scraping operations take place in a sealed environment, enabling operation at various pressures and temperatures. Contamination is thereby minimized.

It is understood that a variety of control mechanisms with suitable human and/or computer interfaces are preferably provided for the purpose of automating the filling, draining and scraping operations. Manual operation may be alternately enabled through the provision of various actuators.

It will be apparent to those skilled in the art that other modifications to and variations of the above-described techniques are possible without departing from the inventive concepts disclosed herein. Accordingly, the invention should be viewed as limited solely by the scope and spirit of the appended claims.

What is claimed is:

1. A centrifugal separator for separating components of a fluid comprising:

an elongated separator bowl for receiving the fluid, said separator bowl being rotatable about an axis;

an elongated shaft spindle disposed along said axis and partially extending into said separator bowl, said shaft spindle disposed for selective rotation and axial translation relative to said separator bowl;

a variable speed motor coupled to said separator bowl for selectively rotating said separator bowl at a high separating speed and at a lower scraping speed;

a clutch, disposed external to said separator bowl and proximate said shaft spindle, operative to enable rotation of said shaft spindle with said separator bowl at said separating speed when disengaged from said shaft spindle and to prevent rotation of said shaft spindle with said separator bowl at said scraping speed when engaged against said shaft spindle;

a scraper assembly positioned within said separator bowl and coupled to an end of said shaft spindle, said scraper assembly including a plurality of scraper blades extending substantially to an interior surface of said separator bowl, said scraper blades having a scraping width in the direction of said axis substantially less than the length of said separator bowl in the direction of said axis; and a scraper actuator in communication with said clutch and said shaft spindle for selectively moving said clutch, said shaft spindle and said scraper assembly along said axis while said separator bowl is being rotated by said variable speed motor at said scraping speed for removing solids from the interior surface of said separator bowl.

2. The centrifugal separator according to claim 1, wherein the variable speed motor further comprises an electronic brake for stopping the rotation of said separator bowl.

3. The centrifugal separator according to claim 1, wherein said scraper assembly includes three or four scraper blades.

4. The centrifugal separator according to claim 1, wherein said separator bowl is a tubular bowl.

5. The centrifugal separator according to claim 4, wherein said tubular bowl comprises a small diameter in relation to a length thereof so that a ratio between the diameter and the length is at least 5/1.

6. The centrifugal separator according to claim 1, further comprising a residual liquid container movably positionable directly beneath and away from a discharge port of said separator bowl so that liquid drained from said separator bowl is collected when said residual liquid container is disposed directly beneath said discharge port.

7. The centrifugal separator according to claim 6, further comprising a solids receiving container disposable beneath said discharge port, whereby said residual liquid container may be disposed intermediate said discharge port and said solids receiving container, said residual liquid container being disposed away from said discharge port to allow solids to be received by said solids receiving container.

8. The centrifugal separator according to claim 1, wherein said scraper assembly comprises:

a cylindrical hub; and a shaft spindle interface associated with said hub for receiving a shaft spindle, wherein said plurality of scraper blades extend radially and tangentially from points on the circumference of said hub.

9. The centrifugal separator according to claim 8, wherein said scraper assembly further comprises a plurality of feed passages for directing fluid to said plurality of scraper blades, said feed passages extending from said shaft spindle interface through said hub to each of said plurality of scraper blades.

10. The centrifugal separator according to claim 9, wherein each of said plurality of scraper blades is attached to said hub by a respective connecting member extending vertically from one of said points on the circumference of said hub.

11. The centrifugal separator according to claim 8, wherein said plurality of scraper blades comprise three scraper blades at equally spaced points on the circumference of said hub.

12. The centrifugal separator according to claim 1, wherein said shaft spindle and said scraper assembly comprise a fluid feed passage for channeling the fluid into said separator bowl.

13. The centrifugal separator according to claim 12, wherein each of said plurality of scraper blades comprises first and second openings in communication with said fluid feed passage, each of said first openings being disposed at a distal end of a respective one of said plurality of scraper blades adjacent to said interior surface of said separator bowl and each of said second openings being disposed at an intermediate position on a respective one of said scraper blades, said first and second openings for providing an outlet for the fluid feed passage proximate said interior surface of said separator bowl.

14. The centrifugal separator according to claim 1, further comprising a fluid feed cone positioned beneath said separator bowl for providing a fluid feed passage into said separator bowl from below said separator bowl.

15. The centrifugal separator according to claim 14, further comprising a feed cone positioner for raising said fluid feed cone to an upper position in mechanical communication with said separator bowl for feeding the fluid to said separator bowl and for lowering said fluid feed cone away from said separator bowl to enable the draining of liquid from said separator bowl.

16. A method for separating a fluid in a centrifugal separator, comprising the steps of:

(a) rotating an elongated separator bowl and a scraper assembly and shaft spindle disposed therein about an axis at a high separating speed, said scraper assembly including a plurality of scraper blades extending substantially to an interior surface of said separator bowl, said scraper blades having a scraping width in the direction of said axis substantially less than the length of said separator bowl in the direction of said axis;

(b) introducing a fluid to be separated into said separator bowl;

(c) engaging said scraper assembly and said shaft spindle to prevent rotation thereof;

(d) while said scraper assembly is engaged, rotating said separator bowl at a scraping speed substantially less than said separating speed; and (e) while said separator bowl is rotating at said scraping speed, axially moving said scraper assembly and said shaft spindle within said separator bowl to scrape solids that have accumulated along said interior surface of said separator bowl with said plurality of scraper blades.

17. The method according to claim 16, further comprising the step of introducing the fluid into said separator bowl through first and second openings on each of said plurality of scraper blades, each of said first openings being disposed at a distal end of a respective one of said scraper blades adjacent to said interior surface of said separator bowl and each of said second openings being disposed at an intermediate position on a respective one of said scraper blades.

18. A method for operating a centrifugal separator having a tubular separator bowl and an internal scraper assembly, said tubular separator bowl and said internal scraper assembly disposed for rotation about an axis of symmetry thereof, said method comprising the steps of:

(a) draining liquid from said separator bowl, including the steps of (i) positioning a residual liquid container beneath a discharge port in said separator bowl to receive liquid drained from said separator bowl, and (ii) braking the rotation of said separator bowl and said internal scraper assembly; and (b) scraping solids accumulated on an interior surface of said separator bowl into a solids receiving container, including the steps of (i) moving said residual liquid container away from said discharge port whereby said solids receiving container is positioned to receive the scraped solids from said discharge port, (ii) engaging a scraper clutch so that said internal scraper assembly does not rotate with respect to said separator bowl, (iii) rotating said separator bowl while said scraper clutch is engaged, and (iv) while said separator bowl is rotating, moving said internal scraper assembly with respect to said separator bowl along said axis of symmetry.

19. The method according to claim 18, further comprising the steps of introducing a fluid to a shaft spindle of said internal scraper assembly and ejecting the fluid from first and second openings in each of a plurality of radial scraper blades of said internal scraper assembly, each of said first openings at the end of a respective one of said radial scraper blades adjacent an interior surface of said separator bowl and each of said second openings at an intermediate position on a respective one of said radial scraper blades.

20. The method according to claim 18 further comprising the step of rotating said separator bowl at a separating speed before said step of scraping to dry the solids accumulated in said separator bowl.

21. The method according to claim 18, further the step of feeding fluid into said rotatable separator bowl through said internal scraper assembly including the steps of (i) disengaging said scraper clutch from said internal scraper assembly to enable said internal scraper assembly to rotate with said separator bowl, (ii) rotating said separator bowl and said internal scraper assembly together at a separating speed, and (iii) flowing the fluid through feed passages in said internal scraper assembly and out exit ports disposed on said internal scraper assembly proximate said interior surface of said separator bowl.

* * * * *

UNITED STATES PATENT AND TRADEMARK OFFICE

CERTIFICATE OF CORRECTION

PATENT NO. : 6,632,166 B2
APPLICATION NO. : 09/896551
DATED : October 14, 2003
INVENTOR(S) : Robert B. Carr It is certified that error appears in the above-identified patent and that said Letters Patent is hereby corrected as shown below:

Front Page, please add the following information:
--*Attorney*, *Agent*, *or Firm*—Weingarten, Schurgin, Gagnebin & Lebovici LLP--; and Column 8, line 53, claim 21, "further the" should read --further comprising the--.

Signed and Sealed this

Sixth Day of February, 2007

JON W. DUDAS
*Director of the United States Patent and Trademark Office*